US005147134A

United States Patent [19]

Bradley et al.

[11] Patent Number: 5,147,134

[45] Date of Patent: Sep. 15, 1992

[54] PROCESS FOR THE CONTINUOUS PRODUCTION OF HIGH-INTERNAL-PHASE-RATIO EMULSIONS

[75] Inventors: Guy M. Bradley, Chesterfield; Todd D. Stone, St. Louis, both of Mo.

[73] Assignee: Petrolite Corporation, St. Louis, Mo.

[21] Appl. No.: 724,699

[22] Filed: Jul. 2, 1991

Related U.S. Application Data

[63] Continuation-in-part of Ser. No. 334,643, Apr. 6, 1989, which is a continuation-in-part of Ser. No. 898,663, Aug. 21, 1986, abandoned.

[51] Int. Cl.[5] ..... B01F 15/02

[52] U.S. Cl. ..... 366/150; 366/279

[58] Field of Search ..... 366/315, 316, 305, 307, 366/279, 293, 343, 317, 302, 247, 249, 250, 251, 150; 252/309, 310, 311, 311.5, 312, 314

[56] References Cited

U.S. PATENT DOCUMENTS

| | | | |
|---|---|---|---|
| 3,183,099 | 5/1965 | Schultz et al. | 366/305 |
| 3,284,056 | 11/1966 | McConnaughay | 366/192 |
| 3,321,283 | 5/1967 | Ewald | 366/173 |
| 3,684,251 | 8/1972 | Bowling | 366/177 |
| 3,946,994 | 3/1976 | Mertz et al. | 366/160 |
| 4,018,426 | 4/1977 | Mertz et al. | 366/162 |
| 4,844,620 | 7/1989 | Lissant et al. | 366/161 |

*Primary Examiner*—Harvey C. Hornsby
*Assistant Examiner*—Reginald L. Alexander
*Attorney, Agent, or Firm*—Stanley M. Tarter

[57] ABSTRACT

A process for producing high-internal-phase-ratio emulsions (HIPREs) on a continuous basis and an apparatus particularly suited for such process having structurizing elements, or mixing blades, adapted to provide complete mixing of the phases.

7 Claims, 1 Drawing Sheet

PROCESS FOR THE CONTINUOUS PRODUCTION OF HIGH-INTERNAL-PHASE-RATIO EMULSIONS

CROSS-REFERENCE TO RELATED APPLICATIONS

This application is a continuation-in-part application of U.S. patent application Ser. No. 07/334,643, filed Apr. 6, 1989 which is a continuation-in-part application of U.S. patent application Ser. No. 06/898,663, filed Aug. 21, 1986, now abandoned.

BACKGROUND OF THE INVENTION

This invention relates to a continuous process for the preparation of stable, thixotropic high-internal-phase-ratio emulsions (HIPREs) having non-Newtonian flow characteristics, to an improved apparatus for use in the production of HIPREs on a continuous basis, and to methods of use thereof. More particularly, the present invention relates to improvements in structurizing elements, or blades, which are adapted to be utilized in such apparatus to provide sufficient mixing of phases to produce HIPREs on a continuous basis.

An emulsion is defined as a continuous liquid phase in which is dispersed a second, discontinuous liquid phase. When one liquid phase is introduced with agitation into another liquid phase with which is immiscible, the introduced liquid phase will disperse into discrete droplets. If the two liquid phases are pure, the droplets will begin to coalesce when agitation is stopped and two discrete layers will form. If, however, appropriate surface active materials, generally referred to as emulsifiers, are present in the system, coalescence will be prevented such that when agitation is stopped a layer of droplets of the dispersed phase will form. If the droplets of the dispersed phase, or internal phase, are small enough so that thermal and Brownian forces overcome the settling effect of the gravity field, then a stable emulsion results.

As recently as about 1967, it was believed that emulsions containing above about 75% by volume of internal phase could not be prepared due to theoretical considerations of structural packing densities and the failure of anyone to be able to prepare such emulsions. However, it was then discovered that by using unusual mixing techniques that emulsions having an internal phase of from 75% to over 99% by volume could be prepared. Emulsions comprising greater than 75% by volume internal phase (dispersed phase) are referred to a high-internal-phase-ratio emulsions (HIPREs). The droplets present in HIPREs are deformed from the usual spherical shape into polyhedral shapes and are locked in place. Thus, HIPREs are sometimes referred to as "structured" systems and display unusual rheological properties which are generally attributed to the existence of the polyhedral droplets. For example, when HIPREs are subjected to sufficiently low levels of shear stress, they behave like elastic solids. As the level of shear stress is increased, a point is reached where the polyhedral droplets begin to slide past one another whereby the HIPRE begins to flow. This point is referred to as the yield value. When such emulsions are subjected to increasingly higher shear stress, they exhibit non-Newtonian behavior, and the effective viscosity decreases rapidly.

When the shear rate ranges between 3,000–8,000 $sec^{-1}$, the effective viscosity approaches the viscosities of the external and internal phases. At increasingly higher rates of shear, a point is reached where the emulsifying agents can no longer maintain stable films, and at this point the emulsion breaks and cannot be reconstituted readily. The yield value and shear stability point, as well as the shape of the viscosity versus shear rate curve, will vary with each particular emulsion formulation.

The "structured" nature of HIPREs, in addition to providing an explanation for the unusual rheological properties displayed thereby, also provides an explanation for the fact that special mixing methods are required in order to prepare such emulsions. If an attempt is made to mix two liquid phases of highly disparate viscosities, one finds that the mixing process is difficult and inefficient. When a small amount of low viscosity liquid is added to a mass of high viscosity liquid, it is difficult to incorporate homogeneously with conventional mixing means. Without appropriate mixing, as more of the low viscosity liquid is added, the highly viscous phase tends to break up and form a coarse dispersion in the thinner liquid. It is this fact which makes the preparation of high-internal-phase-ratio emulsions difficult and which has prevented development of successful continuous emulsification processes for materials of this type. With the correct type and degree of mixing, however, the low viscosity liquid can be adequately dispersed within the high viscosity liquid as it is added to form a stable emulsion. The original processes for manufacturing HIPREs were discontinuous processes which have economic disadvantages in a commercial production situation. These discontinuous processes invariably involved the preparation of a dispersion having a low portion of internal phase and subsequently adding additional internal phase until the emulsion contained over 75% internal phase. Such processes were cumbersome, but they could be successfully employed using conventional mixing equipment.

One attempt at developing a continuous process for the production of HIPREs is disclosed in Lissant U.S. Pat. No. 3,565,817 and is directed at achieving sufficient mixing by providing shear rates high enough to reduce the effective viscosity of the emulsified mass near to the viscosities of the less viscous external and internal phases. However, for certain types of emulsions, it is not possible to apply enough shear thereto to effect an apparent viscosity near those of the external and internal phases without going above the shear stability point of the emulsion. Low-fat spread emulsions (margarine) are examples of such emulsions. For example, the viscosities of the emulsions disclosed in U.S. Pat. No. 3,565,817 display an effective viscosity of less than 300 cps in the mixing region which, according to the disclosure therein, is about $10^4$ $sec^{-1}$ (shear rate), while the viscosities of low-fat spreads, when extrapolating the shear rate plot thereof to the same mixing region, display viscosities of about 6,000 cps. Furthermore, although a variety of structurizing elements are capable of producing shear rates sufficient to reduce the effective viscosity of the emulsion phase to near the external and internal phase viscosities thereby allowing the phases to be mixed to a certain degree, such elements do not provide complete mixing of the phases as evidenced by the fact that there is always some non-emulsified liquid present in the prepared emulsion.

Mertz U.S. Pat. No. 3,946,994 and related Mertz U.S. Pat. No. 4,018,426 disclose a static mixer approach to the production of HIPREs. This approach, however, suffers from the fact that static mixers will not work for all product types, they lack sufficient shear to produce a high quality product, and they are very intolerant of minor process variations such as raw material delivery pressure variations.

One unusual approach aimed at the problem of continuously producing HIPREs is that of Bowling U.S. Pat. No. 3,684,251. This reference uses a series of from 7 to 21 individual mixing chambers to prepare HIPRE emulsions. In the first mixing chamber the external phase is introduced at twice the flow rate of internal phase. Thus, the first chamber produces an emulsion having only about 33% internal phase. The reference then gradually adds additional internal phase until the desired volume percent of internal phase is emulsified. The difference between this and convention batch processes, is that this references adds the additional internal phase not in the original mixing vessel, but with each addition of internal phase the mixing takes place in a new mixing vessel. Thus, this approach to a continuous process is to string together a series of 7 to 21 discontinuous processes. As can be seen from the drawings in this reference, the apparatus is exceedingly complex because of the need to separately meter internal phase into each separate mixing chamber. If any one of the 7 to 21 flow meters is not properly set, the desired emulsion will not be produced. Because of the complexity of the apparatus and its operating parameters, the possibility of failure is orders of magnitude higher than the possibility of failure of a much simpler conventional device.

It has now been discovered that complete mixing can be effected without applying sufficient shear to reduce the effective viscosity of the emulsified mass to near the viscosities of the external and internal phases. Furthermore, it has now been discovered that by providing complete mixing, the present of non-emulsified liquid in the prepared emulsion is significantly reduced or eliminated whereby improvements in the quality of emulsions, in terms of texture, is achieved. This is important in the cosmetics and food industries, as well as others, where product appearance is a major marketing factor.

Therefore, the present invention overcomes the shortcomings and disadvantages of prior art process for the production of HPREs on a continuous basis by providing an apparatus which includes a plurality of structurizing elements which are adapted to provide complete mixing of the phases.

The aforementioned U.S. Pat. No. 3,565,817 discloses an apparatus adapted to be utilized in a process for the continuous production of HIPREs including a mixing chamber equipped with mixing blades. The structure of such mixing blades is not disclosed.

U.S. Pat. Nos. 2,673,077; 2,682,276; 3,166,303; 3,207,488; 3,565,817; 3,939,073; and 4,128,342 all disclose mixing blade structures. Also note, for example, GB 841,743; DE 1,001,663; DE 2,753,153; JP 55-134634 and CS 71,479. None of the mixing blade structures disclosed in these patents are adapted to provide complete mixing of the phases to produce HIPREs on a continuous basis.

McConnaughay U.S. Pat. No. 3,284,056 discloses an apparatus for producing bituminous emulsions such as asphalt-in-water. Although called "emulsions", the products of this patent might actually be suspensions. Emulsions can be used to carry solid particles, but the concept of an emulsions requires one liquid phase dispersed in another liquid phase. In any event, this reference is definitely not directed at preparing HIPRE emulsions, and furthermore, it employs very narrow spacing between its mixing elements and would not produce acceptable HIPREs. Although the blades of this reference are apparently capable of producing a large amount of shear, shear alone is not sufficient to produce a stable HIPRE (in fact, too much shear can destroy a stable HIPRE).

The difficulty in preparing HIPREs is in part due to the unusual rheological properties of these materials. The internal and external phases of the HIPRE are themselves of relatively low viscosity, but as the emulsion is formed, the viscosity of the emulsion becomes very high. However, it is quite difficult to blend a low viscosity liquid into a high viscosity liquid. Thus, once the emulsion begins to thicken, the remaining low viscosity internal phase is very difficult to incorporate into the emulsion and the emulsion begins to break up into coarse droplets which are dispersed in the intended internal phase. It is for this reason that HIPRE emulsions have been very difficult to manufacture. If providing shear alone were sufficient, references such as the aforementioned U.S. Pat. No. 3,684,251 would not have bothered to use 7 to 21 individual mixing chambers. Rather, that reference simply would have used any conventional, high shear mixing blades.

Most so-called continuous emulsification devices which have been employed for the production of low- and medium-internal-phase-ratio emulsions are not suitable for producing high-internal-phase-ratio emulsions because they are not capable of providing sufficient deforming force to the structured systems to move the polyhedral droplets past one another and therefore do not accomplish the required mixing, or such devices produce shear rates in excess of the inherent shear stability point. Most importantly, such devices do not provide for adequate mixing of the phases particularly where there is a large disparity in the viscosities of the two phases to be utilized wherein the polyhedral droplets are locked into a structured system to a greater degree. Thus, colloid mills and other high shear devices cannot be used. Also, low shear mixing devices, such as Hobart mixers or other equipment utilizing slow moving paddle-type stirrers do not provide sufficient deforming force and therefore do not provide complete mixing of the phases to produce HIPREs on a continuous basis.

SUMMARY OF THE INVENTION

The present invention is concerned with providing a process for producing HIPREs on a continuous basis utilizing an apparatus which includes a plurality of novel structurizing elements each of which is particularly adapted to provide complete mixing of the phases. Each of the structurizing elements has two opposing surfaces wherein at least the peripheral portions of the surfaces are separated by a peripheral edge portion. Each of such elements is characterized by a plurality of recesses substantially uniformly spaced around the peripheral edge portion. Preferably, each of such structurizing elements extends to a position adjacent the walls of the mixing chamber such that the space between the edge portion of the structurizing element and the wall of the mixing chamber is less than about 20% of the diameter of the mixing chamber. Each of the present structurizing elements is fixedly attached to and extends outwardly from a rotatable shaft member which is adapted to be engaged at one end thereof by rotator means such as a motor.

DETAILED DESCRIPTION

Figure 1:
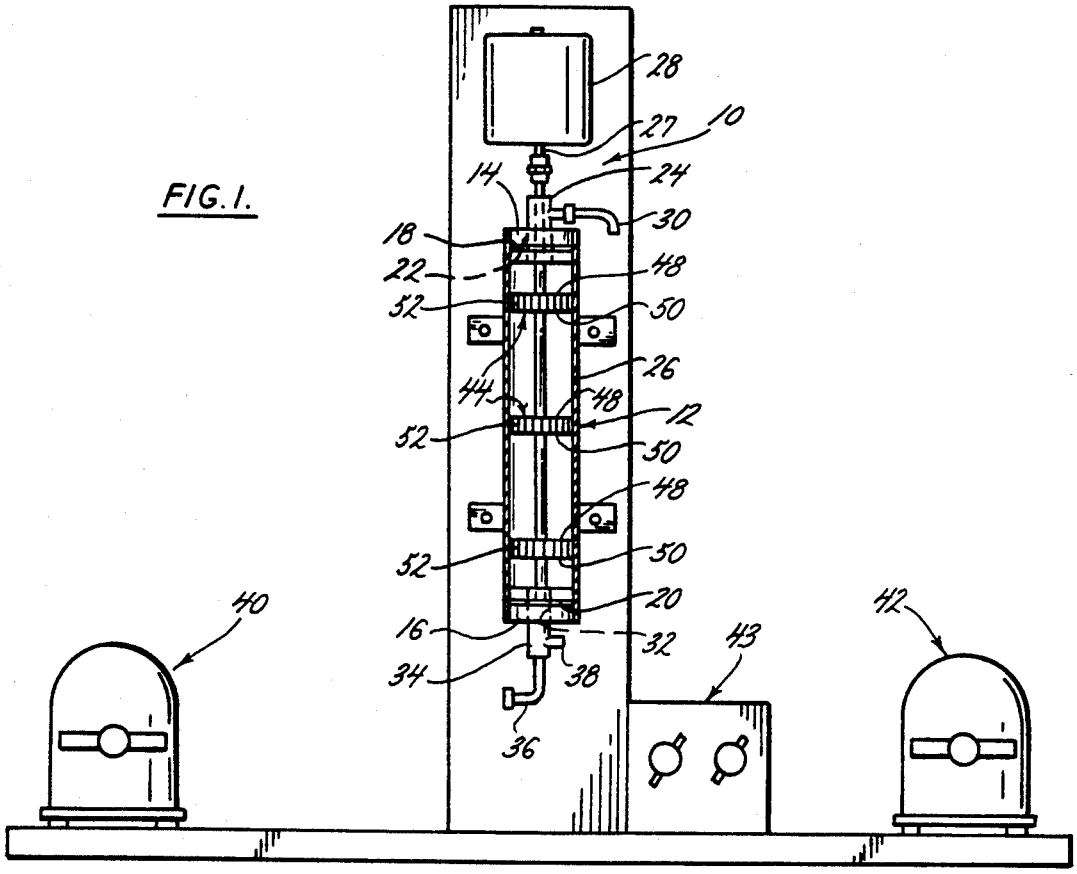
FIG. 1 is a side view of an apparatus adapted to be utilized for the production of HIPREs on a continuous basis, showing a mixing chamber in cross-section and showing a plurality of structurizing elements constructed accordingly to the teachings of the present invention.

Referring to the drawings in which like numerals designate like parts, there is shown in FIG. 1 an apparatus 10 adapted to produce HIPREs on a continuous basis. The apparatus 10 includes a substantially cylindrical mixing chamber 12 which is preferably constructed of a stainless steel-type material, but which can be constructed of other materials, such as glass, for example.

The mixing chamber 12 includes upper plate member 14 and lower plate member 16. Each of the plate members 14 and 16 is attached to respective upper and lower ends 18 and 20 of the mixing chamber 12, such as by standard clamps and bolts (not shown), and each is sealed with a gasket (not shown).

The upper plate member 14 includes an aperture 22 extending substantially through the center thereof. The aperture 22 is fitted with a gland member 24 adapted to receive a stirring shaft 26 therethrough such that the stirring shaft 26 extends from a stirring motor 28 to which one end portion 27 thereof is attached by appropriate attaching means, to and through the gland member 24 and into the mixing chamber 12 to a position adjacent the lower plate member 16. The upper plate member 14 also includes an outlet port 30 through which prepared emulsion can flow as the HIPRE is produced on a continuous basis. Although the outlet port 30 is shown as a part of the gland member 24, it will be recognized by those skilled in the art that an outlet port can be located at any convenient position so long as prepared emulsion can flow therethrough on a continuous basis.

The lower plate member 16 includes an entry port 32 adapted to receive fluids therethrough. The entry port 32 is in fluid communication with the mixing chamber 12 and is adapted to receive a fitting 34 which includes at least two phase introduction ports 36 and 38 through which liquids representing the external and internal phase of the desired HIPRE can be simultaneously and continually introduced into the mixing chamber 12, preferably by way of pumping means such as by pumps 40 and 42, each of which is controlled by controlling means 43. Simultaneous introduction of the external and internal phases into the mixing chamber 12 can also be accomplished in other ways, such as by introducing the phases through opposite sides of the chamber 12 at the appropriate rates.

Figure 2:
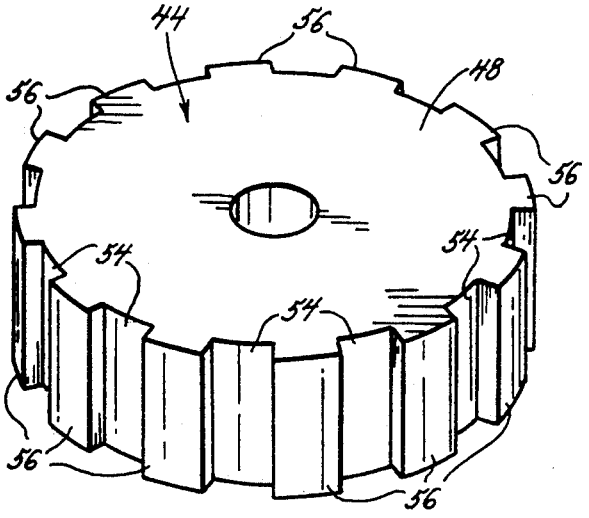
FIG. 2 is a perspective view of one of the structurizing elements shown in FIG. 1.

The apparatus 10 is provided with a plurality of structurizing elements 44 which are particularly adapted to provide complete mixing of the phases without ever producing a shear rate sufficient to reduce the effective viscosity of the emulsion. In the present embodiment, there are three of the structurizing elements 44 and each includes an aperture 46 (FIG. 2) extending substantially through the center thereof through which the stirring shaft 26 extends. The number of structurizing elements 44 can vary depending on the length of the column and the particular type of HIPRE that is desired. Each of the elements 44 is fixedly attached to the stirring shaft 26 by any one of a number of methods known in the art such as by force fitting over splined portions (not shown) of the shaft 26 or by utilizing mounting plates or by utilizing pin members.

Each of the structurizing elements 44 is substantially cylindrical and has a diameter which is preferably the same as or slightly less than the diameter of the mixing chamber 12 and can be as little as about 80% of the diameter of the mixing chamber 12, but desirably no less than about 90%. Each of the structurizing elements 44 includes opposing surfaces 48 and 50 (FIG. 1) which are separated by a circumferential edge portion 52. A plurality of recessed portions 54 (FIG. 2) are preferably substantially uniformly spaced around the circumferential edge portion 52 thereof thereby forming a plurality of short blade-like members 56 which are likewise preferably substantially uniformly spaced around the circumference of each of the elements 44.

It should be noted that the structurizing elements 44 can be of any shape so long as the peripheral surface portions thereof are spaced apart to form a peripheral edge portion. The peripheral edge portion of each of the elements 44 is necessary so that portions thereof can be recessed to form the blade-like members 56 which are important for complete mixing.

The number of blade-like members 56 can vary according to the particular HIPRE produced. Generally, the more viscous the emulsion, the greater the number of blade-like members 56. Where d is the diameter of the structurizing element in inches and n is the number of blade-like members, the value of $\pi d/n$ is desirably between about 0.5 and about 3, preferably between about 0.75 and about 1.6.

The minimum thickness of each of the structurizing elements 44 is primarily determined by the strength of the material utilized to construct such elements. Thicker elements, however, tend to heat the emulsion more than thinner elements, which may be detrimental to certain emulsions. It is preferable that the thickness be at least about one fourth inch and no thicker than the diameter of the structurizing elements 44, such as about three fourths inch to about one third the diameter of the elements 44.

Although the width of the individual blade-like members 56 is not critical, the percentage of the circumference occupied by the blade-like members 56, as opposed to recessed portions 54, should be between about 20% and about 75%, preferably between about 35% and about 55%.

The depth of each of the recessed portions 54 can be from about one sixteenth of an inch to about one half inch, preferably about one eighth to about five sixteenths of an inch.

The spacing between the structurizing elements should be controlled for product quality and mixing efficiency. The unitless ratio of the distance between elements/tube diameter, designated S, is more important than the absolute distance between the elements. If S is too small, the product is poor, exhibiting incomplete mixing of the internal phase. Therefore, S is desirably at least about 0.7, more desirably at least about 0.8, and preferably at least about 0.9. As the value of S increases, product quality becomes consistent, but mixing efficiency decreases. The upper range of S is desirably about 1.3, more desirably about 2, and preferably about 3.

The distance from the edge of the structurizing element to the wall of the mixing chamber is usually not critical. However, for some products (characterized by low emulsifier content (required for aesthetic reasons)), small gaps produce significantly better results. The diameter of the structurizing element is desirably at least 80%, preferably at least 85% and more preferably at least 88% of the inside diameter of the mixing chamber. If the structurizing element of the mixing chamber is made of a suitable low-friction material, there need be no gap. That is, the diameter of the structurizing element can be 100% the diameter of the mixing chamber.

The absolute value of the diameter of the structurizing element is not critical, the main factor being the desired production rate of the apparatus. Element diameters of from about one inch to about nine inches are generally useful, but large and smaller diameters may also be used.

The structurizing elements 44 can be constructed of any one of a variety of materials known in the art, such as stainless steel, nylon, or ultra-high molecular weight polyethylene. If the elements 44 are to have zero clearance with the mixing chamber, then they are preferably constructed of a tetrafluoroethylene polymer material, such as Teflon, or of linear polymers containing a large number of formaldehyde units, such as the polymer Delrin.

The apparatus 10, and particularly any apparatus which utilizes the structurizing elements 44 in a similar manner to that of the apparatus 10, is particularly adapted to be utilized in a process for the production of HIPREs on a continuous basis wherein an external phase liquid and an internal phase liquid are simultaneously and continuously introduced into a mixing chamber comprising such structurizing elements and such internal and external phases are mixed in the presence of an emulsifying agent at a rate sufficient to produce a desired HIPRE.

As the pumping means such as the pumps 40 and 42 simultaneously and continuously introduce the internal and external phase materials into the mixing chamber 12, the mixture of phase materials is forced from a point within the mixing zone of one of the structurizing elements 44 to a point within the mixing zone of another. Thus, in this particular embodiment, movement of the mixture of phase materials through the mixing chamber 12 is dependent upon the means utilized to continuously introduce the external and internal phases, namely, the pumping means. Movement of the mixture of phase materials can also be accomplished by other means such as, for example, reversing the direction of flow through the mixing chamber 12 by inverting the apparatus 10 and allowing the phase materials to move by force of gravity.

The following non-limiting examples are presented for illustrative purposes only and represent the best mode for producing HIPREs on a continuous basis. In the example, all parts and percentages are by weight unless otherwise specified.

EXAMPLES 1-3

General Procedure: A stainless steel column equipped with a plurality of the structurizing elements 44 was utilized in each case. The formulation of phases was as follows:

| Oil Phase | |
|---|---|
| mineral oil | 50.0% |
| polyglycerol polyoleate | 50.0% |
| | 100.0% |
| Aqueous Phase | |
| water | 89.8% |
| 70% sorbitol solution | 10.0% |
| $CaCl_2$ (anhydrous) | 0.2% |
| | 100.0% |

As a start-up procedure, the oil phase liquid was utilized to fill one third of the volume of the column. The mixing motor was then started and the rate was maintained in the range of 1,200 to 1,500 rpm. The water phase liquid was then continuously introduced simultaneously with additional oil phase liquid. After about three column volumes, a steady-state composition comprising, by volume, about 80% discontinuous water phase and about 20% continuous oil phase was achieved and the HIPRE was collected at the flow rate shown.

| Example No. | Column Diameter (millimeters) | Flow Rate (liters/min.) | RPM (of motor used to rotate shaft) | Number of structurizing elements | Length of column (centimeters) |
|---|---|---|---|---|---|
| 1 | 25.4 | 0.1 | 3,300 | 4 | 30.48 |
| 2 | 76.2 | 1.0 | 1,750 | 6 | 60.96 |
| 3 | 152.4 | 9.5 | 1,300 | 6 | 121.92 |

The products produced were smoother and creamier than similar products which were prepared utilizing the same apparatus having various conventional impellers.

EXAMPLE 4

The same general procedure was utilized wherein the external phase material was changed from a mineral oil to a vegetable oil.

| Oil Phase | |
|---|---|
| partially hydrogenated corn oil | 66.5% |
| corn oil | 28.5% |
| polyglycerol polyoleate | 3.3% |
| phosphated mono- and diglycerides | 1.7% |
| | 100.0% |
| Aqueous Phase | |
| water | 97.0% |
| sodium chloride | 3.0% |
| | 100.0% |

The flow rates were 200 ml/min of external phase material and 800 ml/min of internal phase material. The number of structurizing elements was six and the speed of the motor utilized to rotate the stirring shaft was 1,750 rpm. The elements had blades of alternating left-right pitches (the blades of a single element had the same pitch) of about 45°, and edge to edge spacing of three inches. The elements were three inches in diameter and the column inside diameter was three and three tenths inches.

The product was smooth and contained a very negligible amount of free water.

The same external and internal phase materials were introduced into the same column under the same conditions except that the structurizing elements were replaced with convention metal turbines of three inch diameter, having narrow blades pitched at 45°, from a small hub (resembling a boat propeller). The blades of adjacent elements were of opposite pitch. The product was coarse in texture and contained a large amount of unmixed water.

EXAMPLE 5

A vertically oriented glass tube, twelve inches long and one inch inside diameter, was provided with an inlet fitting (bottom), outlet fitting (top), and stirring shaft. The stirring shaft had four Teflon structurizing elements, each having a one inch diameter and one inch thickness. Four recessed portions (one fourth inch toward the center of the element) defined four corresponding blade-like members. The blade members occupied 38% of the circumference of the element. The elements were spaced two and three sixteenths inches between edges.

With the elements rotating at 3,000 rpm, an oil phase was pumped in at 20 ml/min and an aqueous phase was pumped in at 80 ml/min, the phases being mixtures as follows:

| | |
|---|---|
| Oil Phase | |
| phosphated mono- and diglycerides | 1.7% |
| polyglycerol polyoleate | 3.3% |
| vegetable oil | 95.0% |
| | 100.0% |
| Aqueous Phase | |
| water | 97.0% |
| salt | 3.0% |
| | 100.0% |

This produced a good product and except for lack of flavor and color was usable as a low calorie margarine.

When the experiment was repeated with seven structurizing elements spaced five eighths inch apart, the product was poor, exhibiting coarse texture and incompletely mixed water.

EXAMPLE 6

A mixing column was prepared from a six and four tenths inches inside diameter stainless steel tube, forty-eight inches long. Six Teflon structurizing elements each had 12 blade-like portions and corresponding recessed portions one fourth inch deep. The blade-like portions occupied 53% of the circumference of each element. The elements were two inches thick and had a diameter one eighth inch smaller than the inside diameter of the tube (i.e., a one sixteenth inch gap was provided). Using the phases of Example 5, except for the addition of a minor amount of flavor, color, and preservative, the oil phase was introduced at 0.4 gallons per minute and the aqueous phase was introduced at 1.6 gallons per minute. The elements were rotated at between 1,000 and 1,300 rpm. A good product was prepared which was usable as a low calorie margarine.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

What is claimed is:

1. A process for the production of a stable highly viscous high-internal-phase-ratio emulsion (HIPRE) of at least 75% by volume internal phase comprising the steps of:

(a) moving a first liquid having a viscosity substantially lower than the viscosity of the resulting HIPRE product at a first volume flow rate;

(b) moving a second liquid having a viscosity substantially lower than the viscosity of the resulting HIPRE product at a second volume flow rate of at least three times that of the volume flow rate of the first liquid, said first liquid and said second liquid being substantially immiscible with each other with at least one of said liquids containing an emulsifying agent;

(c) simultaneously and continuously metering the first liquid and the second liquid into a confined emulsion forming zone to form a confluent stream of said liquids;

(d) moving the resulting confluent stream undirectionally through the emulsion forming zone;

(e) establishing and maintaining within the confined emulsion forming zone a plurality of low shear mixing stages such that the confluent streams being mixed flows substantially unobstructed between the said mixing stages; and (f) removing the resulting HIPRE product from the confined emulsion zone.

2. The process of claim 1 wherein the second liquid comprises water.

3. The process of claim 2 wherein the first liquid comprises an oil.

4. The process of claim 3 wherein the oil is mineral oil.

5. The process of claim 3 wherein the oil is an edible vegetable oil.

6. The process of claim 5 wherein the vegetable oil is corn oil.

7. The process of claim 6 wherein the HIPRE is a low fat spread emulsion.

* * * * *